United States Patent [19]

Hill

[11] Patent Number: 4,924,214

[45] Date of Patent: May 8, 1990

[54] DOOR MAT ALARM

[76] Inventor: Lennard C. Hill, 394 Orange St. #11, Oakland, Calif. 94610

[21] Appl. No.: 339,228

[22] Filed: Apr. 17, 1989

[51] Int. Cl.[5] ..... G08B 21/00

[52] U.S. Cl. ..... 340/666; 340/539; 200/86.5

[58] Field of Search ..... 340/666, 539; 200/86.5; 15/215

[56] References Cited

U.S. PATENT DOCUMENTS

| | | | |
|---|---|---|---|
| 2,637,801 | 5/1953 | Kelley et al. | 307/141 |
| 2,667,654 | 2/1954 | Peterson | 15/215 |
| 2,783,327 | 2/1957 | Luckey | 340/666 |
| 3,886,352 | 5/1975 | Lai | 250/215 |
| 3,991,415 | 11/1976 | Baar, Sr. | 340/541 |
| 4,141,009 | 2/1979 | Fowler | 340/539 |
| 4,319,230 | 3/1982 | Fowler et al. | 340/539 |
| 4,401,896 | 8/1983 | Fowler et al. | 307/118 |
| 4,497,989 | 2/1985 | Miller | 200/86.5 |
| 4,550,311 | 10/1985 | Galloway et al. | 340/531 |
| 4,550,312 | 10/1985 | Galloway et al. | 340/539 |
| 4,551,713 | 11/1985 | Aossey | 340/666 |
| 4,661,664 | 4/1987 | Miller | 200/86 R |
| 4,761,648 | 8/1988 | Ellis | 340/825.64 |
| 4,780,706 | 10/1988 | Bollag | 340/666 |

*Primary Examiner*—Joseph A. Orsino
*Assistant Examiner*—Geoff L. Sutcliffe
*Attorney, Agent, or Firm*—Leon Gilden

[57] ABSTRACT

A door mat alarm is set forth including a flexible mat and encapsulated pressure switches positioned in a matrix throughout the mat whereupon compression of the flexible mat relays pressure to the switches and activates a remotely positioned transmitter to actuate an alarm. A modification of the instant invention includes a transmitter encapsulated adjacent a forward edge of the mat to relay a signal to a remote receiver portably carried by an individual.

1 Claim, 1 Drawing Sheet

DOOR MAT ALARM

BACKGROUND OF THE INVENTION

1. Field of the Invention

The field of invention relates to alarm apparatus, and more particularly relates to a new and improved door mat alarm wherein the same includes a compressible flexible, resilient mat capable of transmitting compression and actuation of switches contained within the mat.

2. Description of the Prior Art

The use of various remote alarm devices is known in the prior art. The devices of the prior art have been of constructions to effect actuation of remote alarms, but have heretofore failed to provide a compressible mat organization capable of providing actuation of a transmitter physically encapsulated within the mat to effect signalling of a remote receiving device. For example, U.S. Pat. No. 2,687,801 to Kelley sets forth a door lock and light control switch arrangement whereupon the ringing of a doorbell or an unlatching of the door actuates a porch light and causes the light to be turned on. Further, a time delay is incorporated to effect turning off of the lights subsequent to the actuation operation. The Kelley patent is set forth as of interest relative to the relationship of a remote indicator device in cooperation with a portal indication means.

U.S Pat. No. 3,886,352 to Lai sets forth an automatic light control system coordinated to provide temporary lighting in darkened areas, typically exteriorly of a dwelling, utilizing various actuation switches, such as photo-cells, pneumatic switches and the like. The patent is of interest relative to the remote actuation of an indicator relative to the actuation of a switch device.

U.S. Pat. No. 3,991,415 sets forth an electrical switch contained within the interior of a door mat to actuate a visual and audible alarm upon the door mat receiving a predetermined pressure, generally in excess of fifty pounds. The patent does not provide the multiple oriented switching arrangement of the instant invention actuatable by the compressing of the door mat and the actuation of the pressure switches in response to the compressing of the door mat, as set forth by the instant invention, and further does not provide for the use of an encapsulated transmitter in association with the switches within the door mat, a set forth by the instant invention.

U.S. Pat. No.4,401,896 to Fowler sets forth a pressure responsive mechanical switch to actuate a circuit upon the compression of the switch. The switch is of interest relative to the available switches that may be utilized by the instant invention. The pressure switch of the Fowler patent is incorporated herein by reference as an example of a pressure switch available to actuate the transmitter of the instant invention.

U S. Pat. No. 4,551,713 to Aossey sets forth a battery powered door mat utilizing an audible alarm circuit to indicate a pressure applied to the door mat to actuate a remote audible alarm.

Accordingly, it may be appreciated that there is continuing need for a new and improved door mat alarm wherein the same addresses both the problems of compactness of organization and ease of use, and in this respect, the present invention substantially fulfills this need.

SUMMARY OF THE INVENTION

In view of the foregoing disadvantages inherent in the known types of alarm devices now present in the prior art, the present invention provides a door mat alarm wherein the same may be compactly and efficiently stored in association with a portal to actuate a remote alarm upon pressurization of a compressible mat associated with the instant invention. As such, the general purpose of the present invention, which will be described subsequently in greater detail, is to provide a new and improved door mat alarm which has all the advantages of the prior art alarm devices and none of the disadvantages.

To attain this, the present invention comprises a flexible door mat containing a matrix of pressure actuated switches actuatable upon compressing of any portion of the compressible flexible door mat to actuate the switches wherein a modification of the instant invention includes a transmitter positioned proximate a forward edge of the mat remote from the switches to activate a remote receiver to indicate the pressurizing of the door mat.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar a they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provIde a new and improved door mat alarm which has all the advantages of the prior art alarm devices and none of the disadvantages.

It is another object of the present invention to provide a new and improved door mat alarm which may be easily and efficiently manufactured and marketed.

It is a further object of the present invention to provide a new and improved door mat alarm which is of a durable and reliable construction.

An even further object of the present invention is to provide a new and improved door mat alarm which is susceptible of a low cost of manufacture with regard to both materials and labor, and which accordingly is then susceptible of low prices of sale to the consuming public, thereby making such door mat alarm economically available to the buying public.

Still yet another object of the present invention is to provide a new and improved door mat alarm which provides in the apparatuses and methods of the prior art some of the advantages thereof, while simultaneously overcoming some of the disadvantages normally associated therewith.

Still another object of the present invention is to provide a new and improved door mat alarm wherein the same utilizes encapsulated pressure sensitive switches for transmitting indication of pressurizing of the associated compressible door mat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 to 6 thereof, a new and improved door mat alarm embodying the principles and concepts of the present invention and generally designated by the references numeral 10 and 11 will be described.

Figure 1:
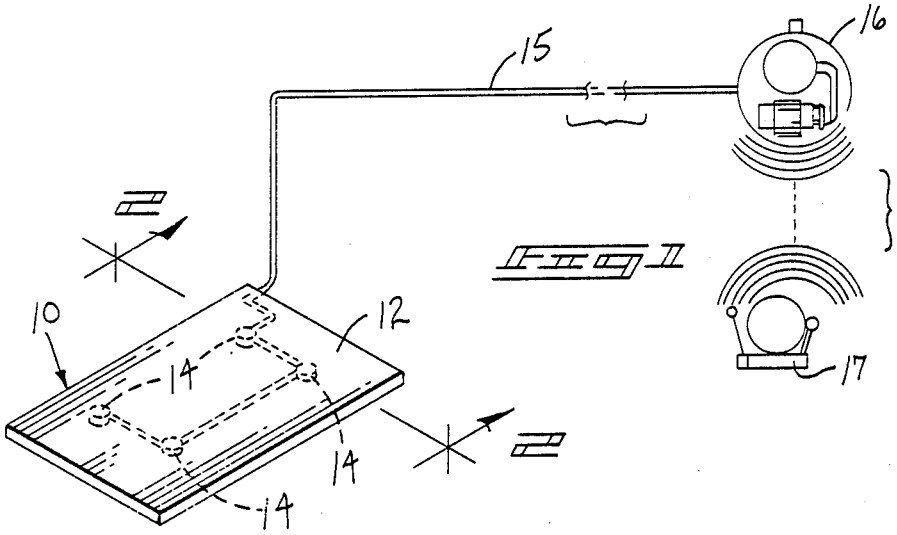
FIG. 1 is an isometric illustration of the instant invention.
Figure 2:
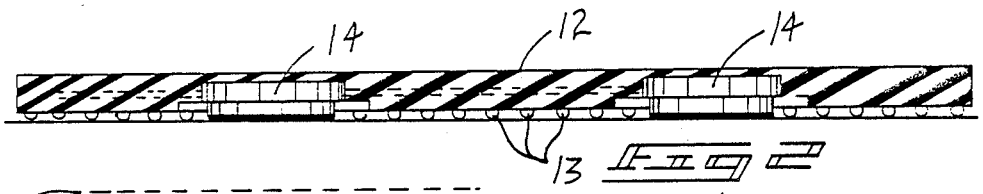
FIG. 2 is an orthographic view taken along the lines 2—2 of FIG. 1 in the direction indicated by the arrows.
Figure 4:
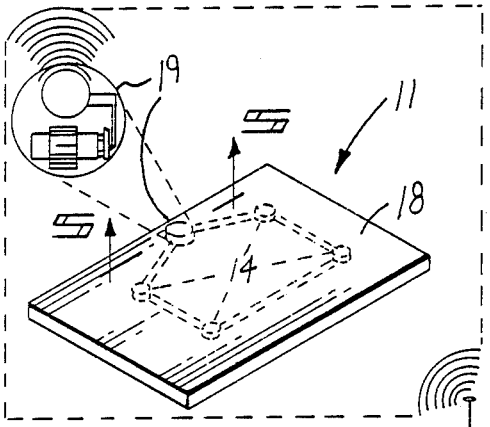
FIG. 4 is an isometric illustration of a modification of the instant invention.
Figure 3:
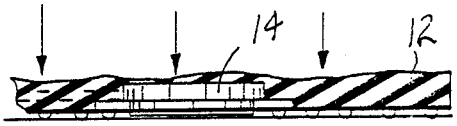
FIG. 3 is an orthographic view of a diagrammatic representation of the compressible door mat transmitting a pressure signal to an associated switch.

More specifically, it will be noted that the door mat alarm apparatus 10 essentially comprises a compressible flexible door mat formed desirably of a compressible polymeric material to enable transmission of a compressive force imposed upon the surface of the mat and direct such force throughout the mat, as illustrated in FIG. 3 for example. Underlying and directed orthogonally downward from the bottom surface 12*a* of the mat are a series of flexible friction projections 13 to assist in orienting the mat in a predetermined relationship relative to a support surface. Encapsulated throughout the mat are a series of pressure responsive switches 14 to accept and complete electrical circuit and direct such a signal through an associated electrical conduit 15, as illustrated in FIG. 1, to actuate a transmitter 16 which in turn is operative to effect actuation of an audible alarm 17.

Figure 5:
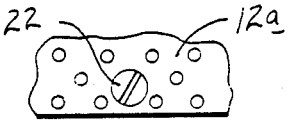
FIG. 5 is an orthographic view taken along the lines 5—5 of FIG. 4 in the direction indicated by the arrows.
Figure 6:
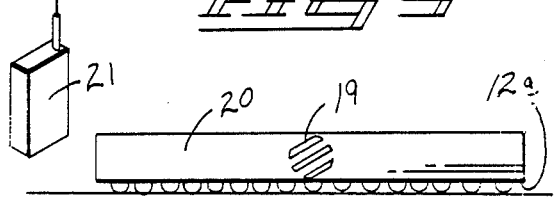
FIG. 6 is an orthographic view taken in elevation of the forward edge of the compressible door mat.

A further preferred embodiment of the instant invention includes a modified flexible mat 18 of the similar force transmitting material utilized in the mat 12 that is compressible to actuate a matrix of the pressure responsive switches 14 within the mat 18. The modified mat 18 includes an encapsulated transmitter 19 positioned proximate a forward edge 20 of the mat 18 to remove the transmitter from the preponderance of pressure forces that will be directed onto the surface of the mat and position the transmitter adjacent a forward edge, as illustrated in FIG. 6, to enhance the signal transmission capabilities of the transmitter. A remote portable receiver 21 may be carried by an individual to indicate to such individual a transmission signal indicating the imposition of a force onto the surface of the mat. FIG. 5 illustrates a battery access cover 22 removably mounted through the bottom surface 12*a* of the mat to enable replenishment of a battery powered source for powering the transmitter 19 encapsulated within the mat, as set forth above.

As to the manner of usage and operation of the instant invention, the same should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door mat alarm apparatus for indication of a mat deforming pressure directed onto an upper surface of said mat, said apparatus comprising, a mat including a forward edge, a rear edge, side edges joining said forward edge and said rear edge, a bottom surface, and said upper surface;

a matrix of pressure responsive switches positioned within said mat for detecting and directing a signal in response to said mat deforming pressure, and a remote receiver for reception of said signal, and wherein said mat comprises an elongate compressible flexible resilient mat, and wherein said mat deforming pressure is operative to actuate said switches remote from said switches, and wherein said apparatus further includes a transmitter encapsulated within said mat, and wherein said transmitter is positioned adjacent a forward edge of said mat, and wherein said remote receiver is portably transportable by an individual, and wherein the bottom surface of said mat includes a matrix of orthogonally and downwardly extending friction projections for maintaining said mat in orientation relative to a support surface, and further including a battery access cover positioned within said bottom surface to provide access to said transmitter and to provide insertion of a battery through said battery access cover to provide power to said transmitter.

* * * * *